United States Patent [19]

Okada et al.

[11] Patent Number: 4,640,847

[45] Date of Patent: Feb. 3, 1987

[54] PARTIALLY PRESSURE-SENSITIVE RECORDING PAPER

[75] Inventors: Yoshio Okada; Yuriko Igarashi, both of Iwaki, Japan

[73] Assignee: Kureha Kagaku Kogyo Kabushiki Kaisha, Tokyo, Japan

[21] Appl. No.: 690,523

[22] Filed: Jan. 11, 1985

[30] Foreign Application Priority Data

Jan. 17, 1984 [JP] Japan ..... 59-4776

[51] Int. Cl.[4] ..... B41M 5/16

[52] U.S. Cl. ..... 427/150; 346/205; 346/206; 346/213; 346/214; 346/215; 427/151

[58] Field of Search ..... 346/205, 206, 214, 215, 346/213; 427/150–152

[56] References Cited

U.S. PATENT DOCUMENTS 3,016,308 1/1962 Macaulay ..... 346/215

4,139,218 2/1979 Davis et al. ..... 346/206

FOREIGN PATENT DOCUMENTS 1349063 3/1974 United Kingdom ..... 346/214

*Primary Examiner*—Bruce H. Hess

*Attorney, Agent, or Firm*—Oblon, Fisher, Spivak, McClelland & Maier

[57] ABSTRACT

Disclosed herein is a process for producing a partially pressure-sensitive recording paper comprising dispersing microcapsules containing a solution of color-former, into a thermally melting suspension medium selected from the group consisting of Japan tallow (haze wax), Carnauba wax, Montan wax, paraffin wax, microcrystalline wax, polyethylene wax, oxidized wax and the mixtures thereof, thereby obtaining an ink comprising the microcapsules and the thermally melting suspension medium, and painting the thus obtained ink on a specified part of a surface of a sheet of paper.

3 Claims, No Drawings

PARTIALLY PRESSURE-SENSITIVE RECORDING PAPER

BACKGROUND OF THE INVENTION

The present invention relates to a process for producing a partially pressure-sensitive recording paper, and more in detail, the present invention relates to a process for producing a partially pressure-sensitive recording paper prepared by painting an ink comprising thermally melting suspention medium and microcapsules encapsulating a colourless solution of a colour-former on a specified part of a surface of a sheet of paper.

In recent years, the recording papers for computer or businessform such as slips for business have come to be more and more complicated and diversified in accordance with the improvement of business efficiency and mechanization of business, and a considerable number of the businessforms take the form including a plurality of copying sheets.

Although in such cases, the pressure sensitive recording paper is frequently used, the conventional pressure sensitive recording paper is made by superposing an upper sheet of paper (hereinafter referred to as CB sheet) having the back surface thereof painted with microcapsules containing a solution of the so-called leucotype dyestuff (as a colour-former) as the core substance onto a lower sheet of paper (hereinafter referred to as CF sheet) having the front surface thereof painted with acid clay or an acidic resin (as a developer), and in the actual use, by the application of writing pressure by a pen or printing pressure by a typewriter, the microcapsules at the pressed part(s) are broken to contact the colour former with the developer, thereby causing coloration and resulting in printing of the handwritten or typewritten items. In the case of pressure sensitive recording paper having a number of copying sheets, one or more sheets of paper each having both the front surface thereof painted with a developer and the back surface thereof painted with microcapsules containing a colour former (hereinafter referred to as CBF sheet(s)) is or are inserted between the CB sheet and the CF sheet, and the thus prepared multi-layered paper is used for the purpose.

However, since the microcapsules have been painted on the whole surface of the sheet material, it is necessary to desensitize the developer on the part(s) of the surface of the sheet material by the use of a reducer ink (de-sensitizing ink) or the like in the cases where only a specified number of the sheets of recording paper should be copied or only a specified part(s) of a slip should be copied, for preventing the unnecessary copying. Such a technique would require much labor and it is inevitable to waste the microcapsules on the part(s) not to be copied or on the number of sheets of copying paper by the de-sensitizing.

In view of the above-mentioned demerit of the conventional pressure sensitive recording paper, it is considered that a recording paper which is partially pressure-sensitized can be obtained without using any desensitizing ink, if it is possible to retain the microcapsules only on the really necessary part of the surface of the CB sheet. Namely, in the case where a pressure sensitive recording paper having the microcapsules painted only on the necessary part(s) of the surface thereof can be prepared by a spot-printing method or the like, a really epoch-making pressure sensitive recording paper can be offered.

However, since at present the conventional pressure sensitive recording paper is prepared by painting a surface of base paper with an aqueous slurry-like material comprising a water-soluble binder, water as a solvent, adjuvants and the microcapsules, it is practically almost impossible to apply such a technique mentioned above to the spot-printing and the like, because the thus spot-printed sheet of paper partly wrinkles on drying.

On the other hand, from the economical viewpoint of not using the expensive microcapsules and the technical merits of copy-printing only on the necessary part of the surface, the development of the recording paper which is partially pressure-sensitized has been eagerly requested.

In answering the request, the processes for preparing the recording paper which is partially pressure-sensitized have been developed. As an example, a process wherein the microcapsules are dispersed in an organic solvent containing a vehicle and the thus obtained dispersion is painted only on the specified part(s) of the surface of sheet material by a printing machine of photogravure type or flexo type has been known.

However, such a printing machine cannot be installed easily in any optional place. On the recording paper which is partially pressure-sensitized obtained by the process of painting a dispersion of microcapsules in a solution of a vehicle on a sheet of paper and drying the thus painted paper, the whole surface of the microcapsule is covered by a binder and the microcapsules are fixed onto the surface of the sheet of paper and accordingly, the breaking efficiency of the microcapsules and the transfer efficiency from CB sheet to CF sheet are inhibited resulting in the necessity of painting a large amount of the microcapsules for obtaining a predetermined color density.

Although there is another method for preparing the partially pressure-sensitive recording paper, in which after partially painting a photo-setting adhesive substance on a specified part of a base sheet of paper, the microcapsules are fixed to the thus painted part before the adhesive substance solidifies and then the adhesive substance is made to solidify, since the adhesive substance is highly expensive and it is necessary to install an irradiating apparatus for photo-setting the adhesive substance, there are demerits of the relatively high cost of the thus obtained partially pressure-sensitive recording paper and the troublesome operation of preparing thereof.

In addition, as the partially pressure-sensitive recording paper prepared by using a conventional thermally melting ink, those prepared by partially painting a so-called carbon ink made by suspending a coloured pigment such as carbon black, etc. in the thermally melting ink on a base sheet of paper have been well known and broadly used because of the simplicity of printing and the low price of the product. However, the problem of soiling the cloth and the hands of the user thereof could not have been solved because of the ink obtained by only mixing the coloured pigment with the wax. Several methods of reducing such soiling as far as possible have been devised as follows.

For instance, a light-coloured pigment of light cobalt or light blue in colour is used, or on the other hand, a dark black pigment is used in preparing a hard carbon ink for use under a relatively strong pressure in copying. However, any methods devised hitherto were not sufficient to prevent the soiling of the cloth and the hands.

On the other hand, concerning the pressure-sensitive recording paper prepared by using a thermally melting ink containing the microcapsules encapsulating a colourless solution of a colour-former, those entitled with the pressure-sensitive recording paper of a non-carbon type have been disclosed in U.S. Pat. No. 3,016,308, Japanese Patent Application Laying Open No. 53-11610 and Japanese Patent Application Laying Open No. 53-135720.

For instance, U.S. Pat. No. 3,016,308 discloses a pressure-sensitive recording paper prepared by painting a thermally melting ink containing microcapsules obtained by spray-drying a dispersion of a solution of a colour-former in a solution in which a material for wall membrane of the microcapsule has been dissolved. However, in the case of the microcapsules obtained by the spray-drying method since the wall membrane thereof within at most a few minutes is formed, the wall membrane is poor in the compactness and accordingly, it is difficult to retain the material encapsulated therein safely during the preparation of the ink or the preservation thereof.

The method disclosed in Japanese Patent Applications Laying Open Nos. 53-11610 and 53-135720 comprises the steps of mixing an aqueous slurry of the microcapsules with a fluid thermally melting suspension medium, removing the moisture or the volatile organic solvent therefrom under a reduced pressure, thereby obtaining a non-aqueous and thermally melting ink in which the microcapsules have been dispersed, and painting the thus obtained ink on a sheet of paper. However, since it is necessary to carry out heating under a reduced pressure for the removal of the moisture from the ink by evaporation together with the vigorous stirring, thus such a treatment inevitably causing the breakdown of the microcapsules, there is a demerit of low in the colour-developing efficiency.

Namely, one of the reasons why a partially pressure-sensitive recording paper utilizing a thermally melting ink and showing a high colour-developing efficiency could not have been obtained is based on the fact that in the case of preparing the microcapsules, the wall membrane thereof is subjected to severe conditions due to the necessity of removing the aqueous medium because of the necessity of uniformly dispersing the thus prepared microcapsules in a thermally melting suspension medium for making the ink.

In consideration of the above-mentioned problems, the present inventors have studied the method for producing the partially pressure-sensitive recording paper of a high colour-developing efficiency at a low price, and as a result, they have succeeded in obtaining the partially pressure-sensitive recording paper of a high colour-developing efficiency by easily painting a thermally melting ink containing the microcapsules having a wall membrane comprising an aminoplast, which are easily separable from the aqueous medium used in preparing the microcapsules, while using a conventional printing machine for painting a conventional thermally melting ink.

SUMMARY OF THE INVENTION

In an aspect of the present invention, there is provided a process for producing a partially pressure-sensitive recording paper comprising dispersing microcapsules containing a solution of colour-former, into a thermally melting suspension medium selected from the group consisting of Japan tallow (haze wax), Carnauba wax, Montan wax, paraffin wax, microcrystalline wax, polyethylene wax, oxidized wax and the mixtures thereof, thereby obtaining an ink comprising the microcapsules and the thermally melting suspension medium, and painting a specified part of a surface of a sheet of paper with the thus obtained ink.

DETAILED DESCRIPTION OF THE INVENTION

The present invention relates to a process for producing a partially pressure-sensitive recording paper comprising partially painting an ink on a base sheet of paper, the ink being prepared by uniformly dispersing the microcapsules which contain a solution of a colour-former, have the wall membrane made of an aminoplast and are separable by filtration from the aqueous medium which has been used in preparing the microcapsules, in a thermally melting suspension medium via an organic solvent.

Since the microcapsules used in the present invention have the wall membrane thereof made of an aminoplast which forms easily a relatively compact membrane, and are easily separable from the aqueous medium by filtration and titration in the preparation of the microcapsules to be in a free-flowable powdery state, the wall membrane has not been abused in the case of the separation and the ability of the wall membrane to retain the solution of the colour-former has not been spoiled. Accordingly, such a microcapsule is excellent in solvent-resistance and thermal-resistance and has a merit that the property of retaining the solution of the colour-former is not spoiled in the case of forming the ink or the case of painting the ink on the base sheet of paper.

According to the process of the present invention, the microcapsules containing the solution of a colour-former are dispersed in a thermally melting suspension medium to form an ink and then the thus formed ink is painted on a base sheet of paper thereby obtaining the partially pressure-sensitive recording paper.

Namely, the application of the microcapsules onto the base sheet of paper is carried out by the steps of preparing a thermally melting ink made by uniformly dispersing the microcapsules in a thermally melting suspension medium and partially painting the thus prepared ink on the base sheet of paper by a suitable method such as printing.

In the thermally melting ink, as the thermally melting suspension medium, a vegetable wax such as Carnauba wax and Japan tallow (haze wax), a mineral wax such as paraffin wax, crystalline wax and Montan wax, a synthetic wax such as polyethylene wax and oxidized wax, or a mixtures of not less than two selected from the above-mentioned waxes may be used, and any wax may be used for the purpose as far as the melting point of the wax is in the range of from 50° to 150° C. under atmospheric pressure. The thermally melting suspension medium is used in the range of from 20 to 60% by weight of thermally melting ink, and it is preferably used in the range of 30 to 200 parts by weight to 100 parts by weight of the microcapsules. In the case where the thermally melting suspension medium is less than 30 parts by weight to 100 parts by weight of the microcapsules, the adhesiveness of the microcapsules to the base sheet of paper is too poor to form an uniformly painted layer on the sheet. On the other hand, in the case of over 200 parts by weight to 100 parts by weight of the microcapsules, the colour-developing efficiency in the case of superposing the thus painted sheet on a sheet of the CF paper on which the colour-developer has been painted and subjecting the thus superposed sheets to copying is remarkably reduced.

In order to make the powdery microcapsules easily dispersible in the thermally melting suspension medium, a specified means may be utilized wherein the microcapsules are preliminarily dispersed in a suitable organic solvent and the thus prepared dispersion is dispersed in a thermally melting suspension medium. As the organic solvent which can be mixed with the thermally melting suspension medium when heated, and does not remain in the finished partially pressure-sensitive recording paper, hexane, cyclohexane, heptane, octane, nonane, toluene, xylene, ethanol, butanol, propanol, isopropyl alcohol, ethyl butyl ether, di-butyl ether, etc. may be preferably used. The amount of the organic solvent depends on the kind and method for application of the ink on the sheet, however, in many cases, the amount of the organic solvent is preferable in the range of 40 to 80% by weight to the sum of the weights of the microcapsules and the wax.

The thus used organic solvent may be removed by evaporation during the preparation of the ink, however, since the organic solvent is evaporated off from the ink during the printing step, it does not remain in the finished pressure-sensitive recording paper. Namely, the organic solvent acts to retain the low viscosity of the ink during the printing step, and the organic solvent is dissipated after application thereby strongly adhering the microcapsules to the base sheet of paper.

In addition to the thermally melting suspension medium, wood meal, starch, minute particles of a plastic material etc. may be mixed therewith as a protective material for the microcapsules, or an inorganic material such as calcium carbonate, silica powder, talc, etc. may be mixed therewith as a filler.

Further, in order to carry out the adhesion of the ink of the thermally melting suspension medium and the microcapsules to the base sheet of paper more effectively, it is possible to mix a thermally meltable resin such as a natural resin, a derivative thereof, a terpen resin, etc. and a thermally meltable polymer such as a copolymer of ethylene and vinyl acetate, an acrylic resin and a methacrylic resin, etc. with the ink. In addition, for the purpose of adjusting the viscosity of the ink or giving a flexibility to the painted membrane, a vegetable oil such as castor oil, Chinese wood oil, linseed oil, soy-bean oil, palm oil, etc. and a mineral oil such as cylinder oil, spindle oil, etc. may be used by admixing with the organic solvent in an amount of less than 30% by weight to 100 parts by weight of the thermally melting suspension medium. In the case where the amount of the oil is over 30 parts by weight to 100 parts by weight of the thermally melting suspension medium, the adhesion of the microcapsules to the base sheet of paper becomes poor, and the colour-developing efficiency onto the CF paper is reduced.

The microcapsules are easily dispersed by stirring the mixture of the two substances with a spatula or a magnetic stirrer, and the mixing of the thus prepared mixture with the thermally melting suspension medium is achieved easily in the same manner as above.

The wall membrane of microcapsules used in the process of the present invention shows a solvent-resistance and is made up of an aminoplast.

The aminoplast is a resin produced by polycondensation of at least one prepolymer selected from the group consisting of melamine-formaldehyde prepolymers, urea-formaldehyde prepolymers, melamine-urea-formaldehyde prepolymers, melamine-thiourea-formaldehyde prepolymers and melamine-thiourea-urea-formaldehyde prepolymers or a mixed prepolymer of a melamine-formaldehyde prepolymer and a thiourea-formaldehyde prepolymer in the presence of a water-soluble cationic urea resin and a low molecular weight anionic surfactant.

Minute droplets of a solution of the colour-former for use in the pressure-sensitive recording paper are dispersed in an aqueous dispersion of the aminoplast. An acid catalyst, for instance, a low-molecular carboxylic acid such as formic acid, acetic acid and citric acid, an inorganic acid such as hydrochloric acid, nitric acid and phosphoric acid or an acidic salt or easily hydrolyzable salt such as aluminum sulfate, titanium oxychloride, magnesium chloride, ammonium chloride, ammonium nitrate, ammonium sulfate and ammonium acetate is added to the thus prepared dispersion and then the prepolymer and water-soluble cationic urea resin in the dispersion are subjected to polycondensation while causing complex-coacervation by the water-soluble cationic urea resin and the low molecular weight anionic surfactant in the aqueous dispersion, thereby forming a hydrophorbic, high-polymeric membraneous wall which completely covers the minute droplets of the solution of the colour-former for use in the pressure-sensitive recording paper, and obtaining the microcapsules in a slurry state.

In this connection, the water-soluble cationic urea resin to be polycondensed together with the aminoplast is that obtained by introducing cationic modifying groups into a urea-formaldehyde resin, for instance, a resin obtained by polycondensing a urea-formaldehyde prepolymer with polyalkylenepolyamine, guanidine, diaminoethanol, dicyandiamide, diethylaminoethanol, guanylurea, etc. As the low molecular weight anionic surfactant, salts of a fatty acid having both the lipophilic group and the anionic hydrophilic group in a molecule thereof, salts of sulfate esters of a higher alcohol and salts of an alkyl aryl sulfonic acid may be mentioned, and, for instance, sodium dodecylbenzene-sulfonate is preferably used.

Further, in the polycondensation for forming the microcapsules, it is important that the two kinds of substances different from each other concerning the sign of the electric charge thereof, i.e., the water-soluble cationic urea resin and anionic surfactant are in coexistence with the above-mentioned prepolymer.

By such a coexistence, it is possible to obtain a stable dispersion and in the same time, it is possible to obtain uniform microcapsules.

Moreover, since almost all the water-soluble cationic urea resin become absent in the aqueous dispersion at the time of completion of microcapsulation, the microcapsules can be easily separated from the reaction system, and only by drying the thus separated microcapsules, it is possible to obtain the freely flowable powdery microcapsules. In addition, during the microcapsulation, a membrane-modifier derived from polyamine or phenol may be admixed with the aqueous dispersion and a membrane-reinforcing agent such as polyisocyanate may be admixed with the core material in the microcapsules.

The powdery microcapsules for use according to the present invention are obtained by separating the thus prepared microcapsules from the slurry-like mixture of the microcapsules by a filter paper, etc., washing the thus separated microcapsules with water and drying the thus washed microcapsules.

As a method for partially painting the thermally melting ink according to the present invention on the base sheet of paper, a method of printing while using a printing machine which can handle an ordinary thermally melting carbon ink is mentioned, and the thermally melting ink according to the present invention can be painted also while using a stamping method by a rubber plate or metal plate.

The partially pressure-sensitive recording paper according to the present invention can be used as a CB paper having the microcapsules painted on the underside thereof, of course, and can also be used as a CBF paper having a colour-developing agent painted on the other side.

The herein-mentioned partially pressure-sensitive recording paper in the present invention includes the CB paper and/or a combined pressure-sensitive recording paper comprising the CBF paper and the CF paper, and of course, includes a single CB paper or a single CBF paper.

The present invention will be explained more concretely while referring to the following non-limitative examples.

EXAMPLE 1

Preparation of heat-resistant microcapsules for use according to the present invention:

(1) Preparation of prepolymers

An aqueous solution of melamine-formaldehyde prepolymer (hereinafter referred to M4F prepolymer, M4F meaning the molar ratio of formaldehyde to melamine of 4:1) was prepared by mixing 63 g of melamine and 162 g of an aqueous 37% by weight solution of formaldehyde which had been adjusted to pH of 9.0 by aqueous 2% solution of sodium hydroxide, reacting the mixture at 70° C., after dissolving melamine, immediately adding 225 g of water to the reaction mixture, and stirring the reaction mixture for 3 min.

Separately, an aqueous solution of urea-formaldehyde prepolymer was prepared by mixing 60 g of urea and 146 g of an aqueous 37% by weight solution of formaldehyde which had been adjusted to pH of 8.5 by triethanolamine and reacting the mixture for 1 hour at 70° C., the thus prepared prepolymer being referred to as U 1.8 F prepolymer.

(2) Preparation of a water-soluble cationic urea resin

A mixture prepared by mixing 162 g of an aqueous 37% by weight solution of formaldehyde and 60 g of urea under agitation was adjusted to pH of 8.8 by triethanolamine and reacted at 70° C. for 30 min. Into 40 g of the thus prepared reaction mixture, 24 g of water and 3 g of tetraethylenepentamine were added, and while stirring the mixture at 70° C., pH thereof was adjusted to 3 by 15% hydrochloric acid, thereafter the reaction was carried out for 1 hour. Since pH thereof was gradually reduced during the reaction, aqueous 10% solution of sodium hydroxide was added thereto for adjusting pH thereof to 3, and the reaction was continued at a reduced temperature of 55° C. At the time when the viscosity of the reaction mixture became 200 cps, it was neutralized by aqueous 10% solution of sodium hydroxide. The water-soluble cationic urea resin was obtained as an aqueous solution thereof by adding 400 g of water to the thus prepared reaction mixture.

(3) Microcapsulation:

A mixture of 100 g of the aqueous solution of M4F prepolymer, 50 g of the aqueous solution of U 1.8 F prepolymer, 158 g of the water-soluble cationic urea resin, 62 g of water and 1 g of triethanolamine was adjusted to pH of 5.2 by an aqueous 10% solution of citric acid, and 3 g of an aqueous 10% solution of an anionic surfactant (Neopere®, sodium alkylbenzene sulfonate, made by Kao Atlas Co., Ltd.) were added thereto, the mixture being referred to as A-liquid.

Separately, a solution of 40 g of crystalviolet lactone in 960 g of diisopropylnaphthalene (DIPN) was prepared as a solution of a colour-former and named as B-liquid.

Into A-liquid, 100 ml of B-liquid were emulsified as minute droplets of 2 to 8 μm in diameter by using a homogenizer, and aqueous 10% solution of citric acid was added to the emulsion to adjust pH of the emulsion to 3.6 while stirring slowly thereof at a temperature of 30° C. After stirring the thus treated emulsion for one hour, 200 g of water were added thereto. After stirring the mixture for 3 hours, aqueous 20% solution of citric acid was added to the mixture to adjust pH thereof to 3.0, and a slurry-like matter containing microcapsules was obtained by continuing the stirring for 20 hours. The microcapsules were collected by passing the slurry-like matter through a membrane filter, washed with water and dried in a hot air heater at 35° C. to obtain 125 g of powdery microcapsules of 2 to 8 μm in diameter.

EXAMPLE 2

Preparation of the partially pressure-sensitive recording paper

Into a liquid mixture of 38 g of n-heptane, 2 g of castor oil and 2 g of soy-bean oil, 38 g of the powdery microcapsules prepared in Example 1 and 12 g of oxidized starch were mixed at room temperature to prepare a dispersion of the microcapsules.

Separately, a mixed liquid wax was prepared by comelting 10 g of oxazoline wax (Oxawax® TS-254AA, made by IMC Chemical Group), 8 g of Hoechst wax®-LP (oxidized wax, made by Hoechst Co.) and 30 g of Hoechst wax®-PE 520 (polyolefin wax, made by Hoechst Co.) at 95° C.

While keeping the mixed liquid wax at 95° C. and gently stirring thereof, the dispersion of the microcapsules was added thereto to obtain a thermally melting ink. On partially painting the thus prepared thermally melting ink on a sheet of paper while utilizing a heated metal plate, a sheet of partially pressure-sensitive recording paper having a whitely painted surface was obtained.

On painting the same ink on a sheet of colour-developing paper on which a salicylate had been applied, since development of any colour was scarcely recognized on the painted surface of the paper the microcapsules had not been broken during the preparation of the ink and thereafter.

EXAMPLES 3 to 8

Preparation of the thermally melting ink

Six kinds of the thermally melting ink were prepared in the same manner as in Example 2 except for adopting respectively the thermally melting suspension medium, the composition of the dispersion of the microcapsules and the temperature of melting the waxes as shown in Table 1.

Preparation of the partially pressure-sensitive recording paper

Six sheets of the partially pressure-sensitive recording paper were prepared in the same manner as Example 2 by using the respective six kinds of the ink prepared as above.

TABLE 1

The composition of the waxes and the dispersion of microcapsules of the respective inks used in Examples 2 to 8

| | Mixed liquid wax | | | | | Dispersion of the microcapsules | | | | | | |
|---|---|---|---|---|---|---|---|---|---|---|---|---|
| Example | Wax | (g) | Adherent, etc. | (g) | Melting temperature | Oil | (g) | Organic solvent | (g) | Microcapsule (g) | Other | (g) |
| 2 | Oxazoline wax(1) | 10 | — | | 95° C. | Castor oil | 2 | n-Heptane | 38 | 38 | Starch | 12 |
| | Hoechst wax-LP(2) | 8 | | | | Soy-bean oil | 2 | | | | | |
| | Hoechst wax-PE 520(3) | 30 | | | | | | | | | | |
| 3 | HiMic ® 2095(4) | 30 | — | | 100° C. | Spindle oil | 4 | n-Octane | 50 | 30 | — | |
| | Japan tallow(5) | 15 | | | | | | | | | | |
| | Lauvax ® 2191(6) | 15 | | | | | | | | | | |
| 4 | Palvax ® 1425(7) | 15 | YS-rosin(12) | 10 | 70° C. | — | | Cyclohexane | 80 | 50 | $CaCO_3$ | 15 |
| | Hoechst wax-KST(8) | 5 | (PX 600) | | | | | | | | | |
| | PE wax SP0145(9) | 25 | | | | | | | | | | |
| 5 | Hoechst wax S(10) | 10 | YS-rosin(13) | 10 | 95° C. | — | | n-Heptane | 70 | 50 | — | |
| | Carnauba wax(11) | 7 | (PX 800) | | | | | | | | | |
| 6 | Hoechst wax S | 10 | YS-rosin | 10 | 90° C. | — | | n-Heptane | 20 | 17 | — | |
| | | | (PX 800) | | | | | Cyclohexane | 30 | | | |
| | | | EVA-210(14) | 8 | | | | | | | | |
| 7 | Palvax ® 1425 | 63 | EVA-210 | 3.8 | 70° C. | Palm oil | 2 | Cyclohexane | 80 | 50 | Starch | 20 |
| 8 | Hoechst wax S | 10 | YS-rosin(15) | 10 | 120° C. | Linseed oil | 4 | n-Octane | 60 | 50 | — | |
| | PE wax SP0145 | 15 | (TO 0105) | | | | | | | | | |

(Notes)
(1)made by IMC Chemical Group,
(2)made by Hoechst Co.,
(3)made by Hoechst Co.,
(4)made by Nippon Seiro Co., Ltd.,
(5)melting at 45-50° C.,
(6)made by Nippon Seiro Co., Ltd.,
(7)made by Nippon Seiro Co., Ltd.,
(8)made by Hoechst Co.,
(9)made by Hoechst Co.,
(10)made by Hoechst Co.,
(11)made by Nikko Fine Products Co., Ltd.,
(12)made by Yasuhara Oils and Fats Co., Ltd., PX means a polymer of terpens
(13)made by Yasuhara Oils and Fats Co., Ltd.,
(14)a copolymer of ethylene and vinyl acetate, made by Mitsui Polychemical Co., Ltd.,
(15)made by Yasuhara Oils and Fats Co., Ltd.

EXAMPLE 9

Preparation of the partially pressure-sensitive recording paper

A mixed wax was prepared by comelting 30 g of Palvax ® 1425, 15 g of Hoechst was KST, 15 g of PE wax SP 0145 and 10 g of YS-rosin ® (PX 600) at 80° C., and in the thus prepared mixed wax, 30 g of the powdery microcapsules prepared in Example 1 were added, and by gently stirring the mixture, a thermally melting ink in which the microcapsules were uniformly dispersed was obtained. On partially painting the thus prepared ink on a sheet of paper by using a heated metal blade, a sheet of the partially pressure-sensitive recording paper having a whitely painted surface was obtained. On painting the same ink on a sheet of colour-developing paper on which a salicylate had been applied, since any colour-development could not be recognized, the microcapsules had not been broken during the preparation of the ink.

COMPARATIVE EXAMPLE 1

Preparation of the microcapsules according to the process disclosed in Example 1 of U.S. Pat. No. 3,016,308

In 700 ml of an aqueous 10% by weight solution of a hydroxyethylcellulose (the aqueous 5% by weight solution of the hydroxyethylcellulose showed a viscosity of 300 cps at 20° C.), 30 g of the same B-liquid (a solution of a colour-former) as in Example 1 were emulsified as droplets of an average diameter of one micrometer by using a homogenizer, and the thus obtained emulsion was subjected to spray-drying while blowing out thereof into a drying chamber at 130° C. to obtain dried microcapsules of 10 to 80 micrometers in diameter.

Preparation of a sheet of partially pressure-sensitive recording paper

In the trial for preparing a sheet of partially pressure-sensitive recording paper by preparing a thermally melting ink in the same procedures as in Example 2 except for using 38 parts by weight of the thus prepared microcapsules as above instead of using the powdery microcapsules according to the present invention, and partially painting the ink on a sheet of paper while using a heated metal blade, it was not possible to obtain any sheet of pressure-sensitive recording paper which had a uniformly painted part on the surface. On painting the thus prepared thermally melting ink on a sheet of CF paper on which a salicylate had been painted, since a blue colour was developed on the applied surface of the sheet, a considerable amount of a solution of the colour-former had exuded from the microcapsules.

COMPARATIVE EXAMPLE 2

Preparation of the microcapsules

After preparing a mixture of 100 g of the aqueous solution of M4F prepolymer obtained in the same manner as in Example 1, 50 g of the aqueous solution of U 1.8 F prepolymer obtained in the same manner as in Example 1, and 75 g of an aqueous 5% solution of Scripsate ®520 (a copolymer of styrene and maleic anhydride, made by Monsanto Co.) instead of using the aqueous solution of the water-soluble cationic urea resin and Neoperex ® in Example 1, and adjusting the pH of the mixture to 5.0 by the addition of aqueous 10% solution of sodium hydroxide, 100 ml of the same solution of the colour-former as in Example 1 were dispersed in the mixture by a homogenizer. After adjusting the pH of the dispersion to 3.6 by adding aqueous 10% solution of citric acid while gently stirring the dispersion at 30° C., and reacting the dispersion for one hour, the aqueous 10% solution of citric acid was again added to the dispersion to adjust pH thereof to 3.0, and the thus adjusted dispersion was continuously stirred for 18 hours for microcapsulation. On carrying out the separation of the thus formed microcapsules from the slurry-like mother liquor, it was impossible to separate the microcapsules from the mother liquor by any means. In the case of subjecting the slurry-like mother liquor containing the microcapsules to spray drying, the microcapsules aggregated to each other and it was impossible to obtain the free-flowing powdery microcapsules.

On trying to prepare a thermally melting ink in the same manner as in Example 2 except for using 38 parts by weight of the aggregated microcapsules dried by the above-mentioned spray drying instead of using the powdery microcapsules having the aminoplast wall membrane according to the present invention, the dispersibility of the microcapsules in the medium of the ink was very poor, and on partially painting the thus prepared ink on a sheet of paper while using a heated metal blade, it was not possible to obtain a sheet of partially pressure-sensitive recording paper with the uniformly painted part(s). On applying the thus prepared ink onto a CF paper to which a salicylate had been applied, since a blue colour developed, considerable number of the microcapsules had been broken.

COMPARATIVE EXAMPLE 3

In a molten mixture of 30 g of oxazoline wax and 30 g of de(resin acid) Montan wax at 95° C., 15 g of oxidized starch were added under agitation, and further, 110 g (corresponding to the dried weight of 30 g) of the slurry-like mother liquor containing the microcapsules prepared in Comparative Example 2 were slowly added within about 2 hours while removing water from the whole system by retaining thereof under a reduced pressure of 26 mmHg, thereby preparing a thermally melting ink.

On painting the thus prepared ink on a sheet of paper while using a heated metal blade, although a white-coloured painted surface was obtained on the sheet of paper, on applying the same on a sheet of colour-developing paper on which a salicylate had been applied, a dark blue colour was developed, which showed that a considerable number of the microcapsules had been broken.

COMPARATIVE EXAMPLE 4

In the same manner as in Comparative Example 3 except for using 180 g of the slurry-like mother liquor containing the microcapsules prepared in Example 1 (corresponding to 30 g of the dried microcapsules) instead of using 110 g of the slurry-like material containing the microcapsules prepared in Comparative Example 2, thermally melting ink was prepared. On painting the ink on a sheet of paper while using a heated metal blade, a white-coloured painted surface was obtained. However, on painting the ink on a sheet of color-developing paper on which a salicylate had been painted, since a blue colour was developed on the surface thereof, the microcapsules had been broken.

EXAMPLE 10

Colour-developing test of the partially pressure-sensitive recording papers prepared in Examples 2 and 9 and Comparative Examples 1 to 3.

Colour-developing test was carried out by (1) superposing each of the sheets of partially pressure-sensitive recording papers prepared respectively in Examples 2 and 9 and Comparative Examples 1 to 3 onto a lower paper on which a salicylate had been painted as a colour-developer, in such a manner that the side painted with the microcapsules is opposite to the side painted with the salicylate, (2) applying a pressure of 300 kg/cm$^2$ onto the thus superposed sheets by passing the sheets through a pair of pinch rolls, thereby breaking the microcapsules and (3) thus causing the colour-development followed by measuring the colour density of the thus developed colour by a refractive colour-densitometer (Quantalog ® Densitometer, made by McBeth Co., U.S.A.) while using a gold filter.

The results are shown in Table 2.

TABLE 2

| Amount of microcapsules painted: 2.3 g/m$^2$ | |
|---|---|
| Example or Comparative Example | Colour-density |
| Example 2 | 0.65 |
| 3 | 0.60 |
| 4 | 0.63 |
| 5 | 0.72 |
| 6 | 0.69 |
| 7 | 0.60 |
| 8 | 0.71 |
| 9 | 0.60 |
| Comparative 1 | 0.21 |
| Example 2 | 0.34* |
| 3 | 0.45 |
| 4 | 0.55 |

Note:
*Unevenness of colour-development was noticed.

What is claimed is:

1. A process for producing a partially pressure-sensitive recording paper comprising dispersing dried microcapsules containing a solution of a colour-former into an organic solvent selected from the group consisting of hexane, cyclohexane, heptane, octane, nonane, toluene, xylene, ethanol, propanol, isopropyl alcohol, butanol, ethyl butyl ether and dibutyl ether, further dispersing the thus prepared dispersion into a thermally melting suspension medium selected from the group consisting of Japan tallow (haze wax), Carnauba wax, Montan wax, paraffin wax, microcrystalline wax, polyethylene wax, oxidized wax and mixtures thereof, thereby obtaining an ink comprising said microcapsules, said thermally melting suspension medium and said organic solvent, and painting the thus obtained ink on a specified part of a surface of a sheet of paper, said thermally melting suspension medium being in the range of 30 to 200 parts by weight to 100 parts by weight of said microcapsules, and said dried microcapsules being obtained by dispersing, as a core substance, said solution of a colour-former in an aqueous medium containing at least one prepolymer selected from the group consisting of melamine-formaldehyde prepolymers, urea-formaldehyde prepolymers, melamine-urea-formaldehyde prepolymers, melamine-thiourea-formaldehyde prepolymers and melamine-thiourea-urea-formaldehyde prepolymers or a mixture of a melamine-formaldehyde prepolymer and a thiourea-formaldehyde prepolymer, a water-soluble cationic urea resin and a low molecular weight anionic surfactant, polycondensing said water-soluble cationic urea resin and said prepolymer on the surface of the thus dispersed solvent droplets containing said colour-former by adding an acid-catalyst, while causing complex-coacervation between said water-soluble cationic urea resin and said anionic surfactant, and drying the microcapsules separated from the aqueous dispersion.

2. A process according to claim 1, wherein said organic solvent is in the range of 40 to 80% by weight of the sum of the weights of said microcapsules and said thermally melting suspension medium.

3. A process according to claim 1, wherein said ink contains 20 to 60% by weight of said thermally melting suspension medium.

* * * * *